US008581808B2

(12) United States Patent
Kim et al.

(10) Patent No.: US 8,581,808 B2
(45) Date of Patent: Nov. 12, 2013

(54) PIXEL DRIVING CIRCUIT OF ELECTRO-LUMINESCENT DISPLAY DEVICE AND DRIVING METHOD THEREOF

(75) Inventors: In-Hwan Kim, Seoul (KR); Seung-Chan Byun, Incheon (KR); Jin-Hyoung Kim, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 1372 days.

(21) Appl. No.: 11/987,391

(22) Filed: Nov. 29, 2007

(65) Prior Publication Data

US 2008/0122758 A1 May 29, 2008

(30) Foreign Application Priority Data

Nov. 29, 2006 (KR) ..... 10-2006-0119368

(51) Int. Cl.
*G09G 3/30* (2006.01)

(52) U.S. Cl.
USPC ..... 345/78; 345/77

(58) Field of Classification Search
USPC ..... 345/76–83, 204–215; 315/169.1–169.4
See application file for complete search history.

(56) References Cited

U.S. PATENT DOCUMENTS

| | | | | |
|---|---|---|---|---|
| 7,145,295 | B1 * | 12/2006 | Lee et al. | 315/291 |
| 7,227,519 | B1 * | 6/2007 | Kawase et al. | 345/77 |
| 7,321,199 | B2 * | 1/2008 | Lee et al. | 315/194 |
| 7,479,955 | B2 * | 1/2009 | Yoshida | 345/211 |
| 2002/0101395 | A1 * | 8/2002 | Inukai | 345/83 |
| 2002/0167474 | A1 * | 11/2002 | Everitt | 345/82 |
| 2003/0057895 | A1 * | 3/2003 | Kimura | 315/370 |
| 2005/0030267 | A1 * | 2/2005 | Tanghe et al. | 345/82 |
| 2006/0055631 | A1 * | 3/2006 | Yoshida | 345/46 |
| 2006/0082529 | A1 * | 4/2006 | Oyama | 345/82 |
| 2006/0132402 | A1 * | 6/2006 | Yu | 345/83 |
| 2006/0202630 | A1 * | 9/2006 | Yamada | 315/169.2 |
| 2007/0080905 | A1 * | 4/2007 | Takahara | 345/76 |

* cited by examiner

*Primary Examiner* — Alexander Eisen
*Assistant Examiner* — Patrick F Marinelli
(74) *Attorney, Agent, or Firm* — McKenna Long & Aldridge, LLP

(57) ABSTRACT

The present invention relates to a method for properly controlling the drive current when driving an Active Matrix OLED (AMOLED) in order to prevent the brightness from being changed due to temperature changes in a panel or the performance deterioration of the OLED. The present invention comprises: an OLED (organic light emitting diode) panel that displays an image; pixel driving circuit including: a drive current control unit that outputs a current control signal corresponding to a detected current supplied to the OLED panel; and a comparator that compares the current control signal with a power supply voltage and outputs a bias voltage; and a transistor that receives the power supply voltage and that supplies a drive current to the OLED panel corresponding to the bias voltage.

4 Claims, 2 Drawing Sheets

PIXEL DRIVING CIRCUIT OF ELECTRO-LUMINESCENT DISPLAY DEVICE AND DRIVING METHOD THEREOF

This present application claims the benefit of Korean Patent Application No. 10-2006-0119368 filed Nov. 29, 2006, which is hereby incorporated by reference for all purposes as if fully set forth herein.

BACKGROUND OF THE INVENTION

1. Field of the Invention

The present invention relates to a driving method of an AM-OLED (Active Matrix Organic Light Emitting Diode) panel, and more particularly, to a pixel driving circuit of an electro-luminescent display device that is capable of preventing changes in brightness due to temperature changes in the panel or a performance deterioration of the OLED and a driving method thereof.

2. Discussion of the Related Art

Generally, pixel structures for AM-OLED displays may be broadly classified into voltage-driven pixels, current-driven pixels and digitally-driven pixels according to their driving method.

The voltage-driven pixel has a structure such that a voltage may be driven at a high speed that is similar to a TFT-LCD (Thin Film Transistor-Liquid Crystal Display) driver LSI (Large Scale Integrated Circuit). Accordingly, it is easy to implement the driver LSI. However, the voltage-driven technique has drawbacks in that the brightness between the upper and lower portions of a display panel may be different due to a drop in a pixel power supply voltage, and also crosstalk noise may be generated. Even though non-uniformity of a threshold voltage is in the driving transistor may be compensated to a certain degree, it is difficult to compensate for variations in election mobility in the driving transistors.

The current-driven pixel has a structure such that a current driven. Accordingly, it is easy to compensate for changes in the characteristics of the TFT and is also possible to compensate for a IR drop in the power supply voltage. But, it is difficult to drive a current within a short row line time because a data line presents a large parasitic load upon application of a current having a low gradation.

The digitally-driven pixel structure is very sensitive to the deterioration or characteristic changes in the OLED material.

FIG. 1 is a schematic circuit diagram of a pixel circuit for driving a current in an electro luminescent display device in accordance with the related art.

As shown in FIG. 1, the pixel circuit for driving a current in the electro-luminescent display device includes: a PMOS-FET (P-channel Metal Oxide Semiconductor Field Effect Transistor) driving transistor (T1) and a PMOS FET switching transistor (T2) that are connected in series between a power supply terminal (VDD) and an organic light emitting diode (OLED) in order to supply a drive current to the OLED; a storage capacitor (Cstg) connected between a source terminal and a gate terminal of the PMOS FET driving transistor (T1); a PMOS FET switching transistor (T3) the source terminal of which is connected to a data line (DL) and a drain terminal of which is connected to the gate terminals of PMOS FET transistors (T1), (T2), and having its gate connected to a first gate signal terminal (GATE1); and a PMOS FET switching transistor (T4) the source terminal of which is connected to the data line (DL) and the drain terminal of which is connected to the drain and source terminals of PMOS FET transistors (T1), (T2), respectively, and having its gate connected to a second gate signal terminal (GATE2).

The operation of the pixel circuit of FIG. 1 will be described as follows. First, when the gate signal terminals (GATE1), (GATE2) are at a 'low' level, the switching transistors (T3), (T4) are turned on, respectively. Accordingly, driving transistor (T1) sinks a current from the power supply terminal (supplied from a data driving unit). The current flowing at this time is uniformly sunk, and accordingly the same amount of the current flows to all pixels.

Thus, a voltage corresponding to the sunk current is charged on the storage capacitor (Cstg). But, the characteristics of the driving transistors (T1) in each pixel are different. So, voltages are charged on the storage capacitors (Cstg) in each pixel having different levels.

Thereafter, when gate signal terminals (GATE1), (GATE2) assume a 'high' level, the switching transistors (T3), (T4) are turned off, respectively. At this time, driving transistor (T1) supplies the current corresponding to the voltage charged in the storage capacitor (Cstg) towards the organic light emitting diode (OLED), thereby obtaining an excellent uniformity.

As mentioned above, the OLED is arranged in a matrix to form a panel, and an OLED panel having the above structure is used for displaying an image. The OLED panel is driven by a power supply voltage (VDD) supplied from a DC/DC converter (not shown).

Also, even though PMOS FET transistors are used as the transistors (T1-T4) in the above description, NMOS FET transistors can be also used as well.

The pixel driving circuit of the electro-luminescent display device in accordance with the related art has a problem in that the current supplied to the OLED panel is not properly controlled. Accordingly, the temperature increases and the power supply voltage drops below a predetermined level that causes the OLED panel not to operate properly that results in a deteriorated image quality.

SUMMARY OF THE INVENTION

Accordingly, the present invention is directed to a pixel driving circuit of electro-luminescent display device and driving method thereof that substantially obviates one or more of the problems due to limitations and disadvantages of the related art.

An advantage of the present invention is to provide a pixel driving circuit which is capable of preventing the temperature of an OLED panel from increasing or the level of a power supply voltage from dropping below a predetermined value by properly controlling a current supplied from a DC/DC converter towards the OLED panel, and a driving method thereof.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an electro-luminescent display device includes an OLED (organic light emitting diode) panel that displays an image; pixel driving circuit including: a drive current control unit that outputs a current control signal corresponding to a detected current supplied to the OLED panel; and a comparator that compares the current control signal with a power supply voltage and outputs a bias voltage; and a transistor that receives the power supply voltage and that supplies a drive current to the OLED panel corresponding to the bias voltage.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiment of the invention and together with the description serve to explain the principles of the invention.

In the drawings.

DETAILED DESCRIPTION

Hereinafter, description will be given in detail of the preferred embodiments of the present invention, in conjunction with the accompanying drawings.

Figure 1:
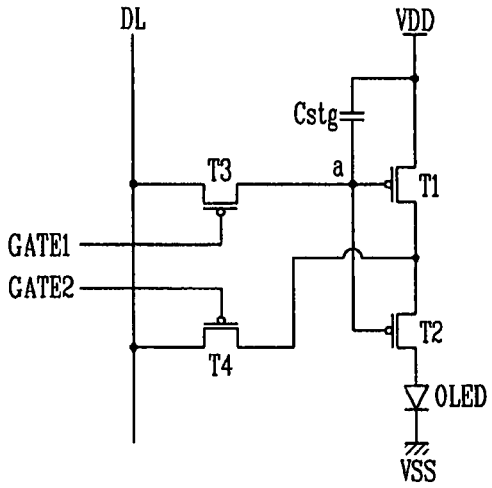
FIG. 1 RELATED ART
FIG. 1 is a schematic circuit diagram of a pixel driving circuit of an electro-luminescent display device in accordance with the related art.
Figure 2:
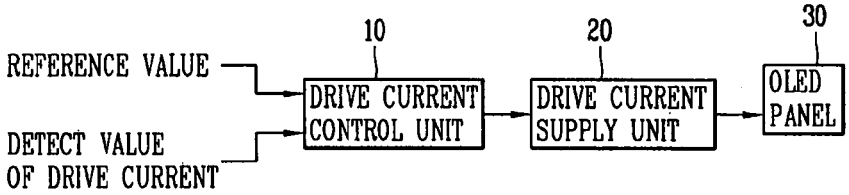
FIG. 2 is a block diagram of the electro-luminescent display device in accordance with the present invention.

FIG. 2 is a block diagram of the electro-luminescent display device in accordance with the present invention.

As shown in FIG. 2, the electro-luminescent display device according to the present invention includes an OLED panel 30, a drive current control unit 10 for detecting the drive current supplied to the OLED panel and controlling the current to be applied to the OLED panel 30 based on the detected current, and a drive current supply unit 20 for supplying the drive current to the OLED panel 30 by the control signal of the drive current control unit 10.

A plurality of gate lines and data lines are disposed in the OLED panel 30 to define a plurality of pixels and first and second thin film transistors are disposed in each pixel. The first thin film transistor includes a gate electrode connected to the gate line to receive the gate signal, a source electrode connected to the data line to receive the data signal, a drain electrode connected to the gate electrode of the second thin film transistor to switch the emitting unit. The second thin film transistor includes a gate electrode connected to the drain electrode of the first thin film transistor, a drain electrode connected to the emitting unit, and a source electrode connected to a power line. In the drive current control unit 10, a reference value is input to be compared with the drive current detected in the OLED panel 30 and the control signal is output to control the drive current to be supplied to the OLED 30 when the deference value between the detected drive current and the reference exceeds aset value.

Figure 3:
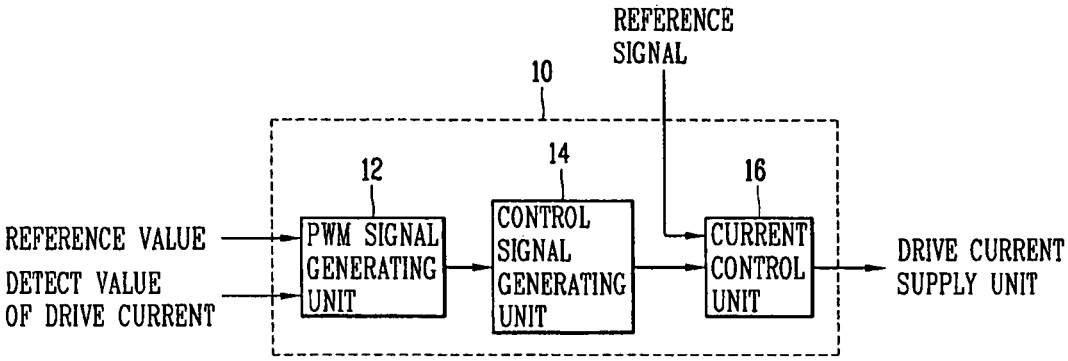
FIG. 3 is a block diagram of the drive current control unit of FIG. 2.

As shown in FIG. 3, the drive current control unit 10 includes a pulse width modulation (PWM) signal generating unit 12 for input the detected value of the drive current supplied to the OLED panel and the reference value to generate the PWM signal when the detected value is different from the reference value, a control signal generating unit 14 for generating the control signal on the basis of the PWM signal input from the PWM signal generating unit 12, and a current control unit 16 to be driven by the control signal from the control signal generating unit 14 to control the drive current supplied to the OLED panel 30.

In general, the current control signal may be produced in several different ways. In this invention, a PWM signal (square wave) having a wave form with a variable duty ratio may be produced in the present invention. In this case, the PWM signal generating unit 14 may output the PWM signal with a duty ratio corresponding to the level of the detected current and the control signal generating unit 14 may output the control signal to drive the current control unit on the basis of the PWM signal.

Hereinafter, we will describe a schematic circuit diagram of an exemplary pixel driving circuit of the electro-luminescent display device.

Figure 4:
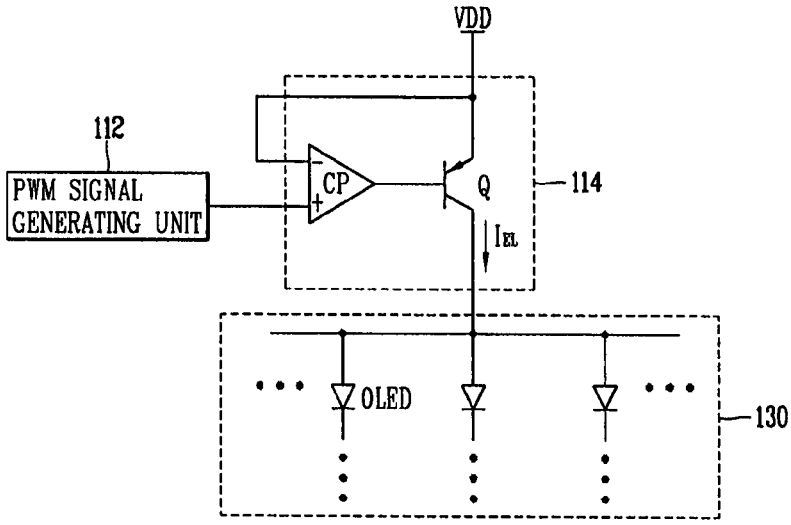
FIG. 4 is a schematic circuit diagram of a pixel driving circuit of an electro-luminescent display device in accordance with the present invention.

Referring FIG. 4, the pixel driving circuit of the electro-luminescent display device in accordance with the present invention may include: a PWM signal generating unit 130 that outputs the PWM signal corresponding to the current detected by detecting a current supplied to an OLED panel 130; a control signal generating unit 114 for outputting the control signal in accordance with the PWM signal from the PWM signal generating unit 112 and the reference signal, a current control unit Q for controlling the amount of the current supplied to the OLED panel 130 from a power supply terminal according to the control signal from the control signal generating unit 114, and the OLED panel 130 for displaying an image using the drive current supplied through the current control unit Q.

Here, the control signal generating unit 114 may include a comparator (CP) comparing the power supply voltage (VDD), i.e., the reference signal, with a square wave voltage of the PWM signal from the PWM signal generating unit 112 and outputting a bias voltage according to the comparison result, and the current control unit Q may include a transistor supplying the drive current corresponding to the bias voltage to the OLED panel 130.

The present invention may include various structures, not limited to above structure. For example, although the control signal is a PWM signal to control the drive current supplied to the OLED panel 130, other control signals generated by other processes may be used to control the drive current.

The operation of the pixel driving circuit of the present invention constructed as described above will be described in detail with reference to FIG. 5 as follows.

The OLED panel 130 may be formed in a structure such that a plurality of OLED pixels are arranged in a matrix in order to display images. The OLED pixels may be driven by particular driving methods, respectively. FIG. 4 depicts a supply path of the drive current ($I_{EL}$) with respect to the pixels.

Figure 5:
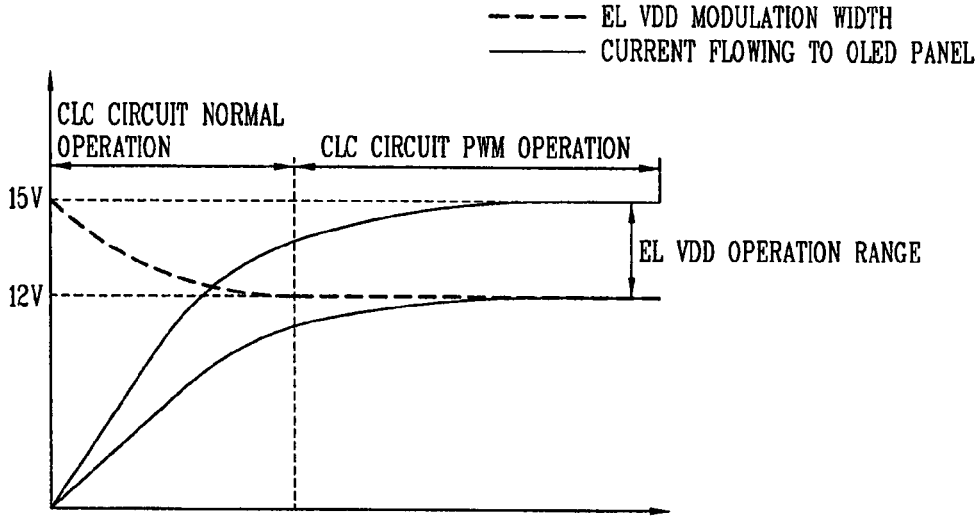
FIG. 5 is a graph showing the relationship between the current and the voltage supplied to an OLED panel.

FIG. 5 is a graph showing the relationship between the drive current ($I_{EL}$) supplied to the OLED panel 130 and the power supply terminal voltage (VDD).

As shown in FIG. 5, the level of the power supply terminal voltage (VDD) varies according to the drive current ($I_{EL}$) The level of the drive current ($I_{EL}$) varies according to a load capacity of the OLED panel 130. Here, when the level of the drive current ($I_{EL}$) is relatively small, the power supply terminal voltage (VDD) may be maintained at a specific level (e.g. 15V). However, when the level of the drive current ($I_{EL}$) is relatively large, the power supply terminal voltage (VDD) may drop below a required voltage level (e.g. 12V), and accordingly, the OLED panel 130 may not be normally operated.

Therefore, the PWM signal generating unit 112 detects the level of the drive current ($I_{EL}$) supplied to the OLED panel 3 through a DC/DC converter and the power supply terminal (VDD) and outputs the PWM signal corresponding to the level of the detected current to the control signal generating unit 114, that is, the comparator.

There are several possible methods for detecting the level of the drive current ($I_{EL}$). For example, the drive current ($I_{EL}$) may be directly detected by a current detection device. In another example, the level of the drive current ($I_{EL}$) may be predicted based on the detected level of the power supply terminal (VDD), because the greater the level of the drive current ($I_{EL}$) is, the lower the level of the power supply terminal voltage (VDD) is, as described above.

The signal controlling the current control unit Q (that is, the transistor) may be produced in several different ways. In this embodiment, the signal has the shape of PWM signal (square wave) of which a duty ratio is variable. In this case, the control signal generating unit 114 output the signal having shape of PWM signal with a duty ratio corresponding to the level of the detected current.

In the transistor Q, the level of the drive current ($I_{EL}$) supplied to the OLED panel 130 from the power supply terminal (VDD) may be varied according to the current control signal applied from the control signal generating unit 114.

The control signal generating unit 114 and the current control unit Q may be implemented in various forms, and it may be implemented with the comparator (CP) and the transistor (Q) in an exemplary embodiment of the present invention. In this case, the comparator (CP) may compare the voltage (VDD), that is, the reference signal, supplied from the DC/DC converter (not shown) to the power supply terminal of the OLED panel 130 with the square wave voltage of the control signal outputted from the drive current control unit 1, and then output the bias voltage to control the operation of the transistor (Q) according to the compared result.

For example, after the comparator (CP) compares the two voltages, when the square wave voltage of the control signal output from the control signal generating unit 114 is in the 'low' period, a 'low' bias voltage may be output to the base of the transistor (Q) to make the transistor (Q) turn on. While, in the 'high' period of the square wave voltage, a 'high' bias voltage may be output to the base of the transistor (Q), and thereby the transistor (Q) may be turned off.

Therefore, as the duty ratio of the square wave of the control signal output from the control signal generating unit 114 increases, the time that the transistor (Q) is turned on decreases. Accordingly, the level of the drive current ($I_{EL}$) supplied to the OLED panel 130 may be reduced.

The level of the power supply terminal voltage (VDD) may be always maintained at a normal operation level (12-15V) by controlling the amount of the drive current ($I_{EL}$) by the above method. In other words, the level of the power supply terminal voltage (VDD) may swing between 12V and 15V as the transistor (Q) is turned on/off by the pulse width modulation signal, and thus the average level of the power supply terminal voltage (VDD) may be maintained at approximately 13.5V. Accordingly, the OLED panel 3 may always be normally operated.

As previously mentioned, the present invention is capable of preventing the temperature of the OLED panel from increasing due to an overcurrent condition and preventing the level of the power supply terminal voltage from dropping below a predetermined value by properly controlling the current supplied to the OLED panel from the DC/DC converter, and thereby implementing a normal operation of the OLED panel.

Also, the present invention is capable of maintaining a uniform brightness even if the temperature of the OLED panel changes or the performance of the OLED is deteriorated.

Further, the present invention is capable of reducing the power consumption by preventing an overcurrent from being applied to the OLED panel.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present inventive features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A pixel driving circuit of an electro-luminescent display device, including an OLED (organic light emitting diode) panel that displays an image, comprising:

a drive current control unit that outputs a current control signal corresponding to a level of a detected drive current by detecting an amount of a current supplied to the OLED panel; and a drive current supply unit that supplies the current to the OLED panel through a power supply terminal according to the current control signal, wherein the current control signal is a pulse width modulation signal, wherein the drive current control unit comprises:

a comparator that compares the current control signal with a power supply voltage and outputs a bias voltage;

a transistor that receives the power supply voltage and that supplies a drive current to the OLED panel corresponding to the bias voltage;

a signal generating unit that generates a pulse width modulation signal that varies according to a difference between a reference value and the detected drive current;

a control signal generating unit that receives the pulse width modulation signal from the signal generating unit and produces a control signal on the basis of the pulse width modulation signal; and a current control unit that receives the control signal and produces the current control signal.

2. The pixel driving circuit of claim 1, wherein as a duty ratio of a square wave of the pulse width modulation signal increases, a level of the drive current supplied to the OLED panel is reduced.

3. A method of driving an electro-luminescent display device comprising:

detecting a level of a drive current;

comparing the drive current with a reference value to produce a drive current control signal; and producing the drive current from a power supply voltage according to the drive current control signal, wherein the drive current control signal is a pulse width modulation signal, wherein the step of producing the drive current comprises:

comparing the drive current control signal with the power supply voltage and outputting a bias voltage;

supplying the drive current to the OLED panel in correspondence to the bias voltage;

generating a pulse width modulation signal that varies according to a difference between the reference value and the detected drive current;

receiving the generated pulse width modulation signal and producing a control signal on the basis of the pulse width modulation signal; and receiving the control signal to produce the drive current control signal.

4. The method of claim 3, wherein as a duty ratio of a square wave of the pulse width modulation signal increases, a level of the drive current supplied to the OLED panel is reduced.

* * * * *